US005497921A

United States Patent [19]

Dancyger et al.

[11] Patent Number: 5,497,921

[45] Date of Patent: Mar. 12, 1996

[54] PAINT CAN HOLDER

[76] Inventors: Michael Dancyger; Larry Litwin, both of 811 W. 58th St., Los Angeles, Calif. 90037

[21] Appl. No.: 349,067

[22] Filed: Dec. 2, 1994

[51] Int. Cl.[6] ..... A45F 5/00

[52] U.S. Cl. ..... 224/148; 224/197; 224/224; 224/226; 224/253; 224/269; 224/904; 224/907

[58] Field of Search ..... 224/148, 191, 224/197, 200, 224, 226, 242, 253, 269, 268, 904, 907

[56] References Cited

U.S. PATENT DOCUMENTS

| | | | |
|---|---|---|---|
| 4,325,503 | 4/1982 | Swinney | 224/250 |
| 4,527,720 | 7/1985 | Hayes | 224/197 |
| 5,016,791 | 5/1991 | Burow | 224/904 |
| 5,067,643 | 11/1991 | McKinney | 224/197 |
| 5,163,591 | 11/1992 | Leiserson et al. | 224/197 |

*Primary Examiner*—Henry J. Recla
*Assistant Examiner*—Timothy L. Maust
*Attorney, Agent, or Firm*—Andra M. Vaccaro

[57] ABSTRACT

A holder for a paint can or other object having a handle is shown that is worn on the belt of a user. The holder comprises a base having a top and a bottom portion, the top portion being folded over the bottom portion and affixed thereto to form a loop which receives the belt of the user. A bracing means is attached to the top portion for holding the handle of the object so that the object will always be held in a vertical position. A swivelling means is attached to the bottom portion of said base and a strapping means is attached to said swivelling means for enclosing said object therein. In use, the object is placed in the strapping means and the handle thereof is attached to the bracing means, such that when the user bends over at an angle, the swivelling means will adjust the object so that it remains substantially upright and level to prevent spillage therefrom.

2 Claims, 4 Drawing Sheets

22
26
20
24
16
14
12
30

PAINT CAN HOLDER

BACKGROUND OF THE INVENTION

Field of the Invention. The invention relates to the field of holders that are worn around the body. It also relates to painting devices for use by painters and other laborers who lift/work with objects that they want to have immediately available and which always remain substantially upright so as to avoid spillage of the contents of the object.

SUMMARY OF INVENTION

The present invention relates to a holder for items such as paint cans for use by construction workers and other laborers, such as painters, requiring the easy accessibility of an object, such as a paint can, without bending and spillage, etc. The present invention offers a generalized means of supporting such an object such that it will always remain substantially upright so as to avoid spilling the contents thereof, while the user stoops, bends over, etc.

The present invention comprises a main body having three layers of material. The first outer layer, which is the closest to the body of the user is comprised of a material such as a heavy duty fabric. The second outer layer, which is closest to the object being held, is made of hard plastic or any other substantially rigid material. The third layer, which is included between the first and second outer layers is comprised of foam for padding and comfort of the user. The three layers are held together by binding that is stitched around the outer edge of the three layers.

The uppermost portion of the main body is bent so as to form a belt loop, such that the first outer layer appears on top of the second outer layer. The loop is formed by bending the uppermost portion and affixing it to an adjacent portion of the remainder of the main body by fastening means, such a rivets.

A bracing device is affixed to the top of the belt loop for vertical support of the object (for example, by the object's handle). In the lower portion of the main body on the second outer layer side is a means for strapping the object to the holder. In the preferred embodiment, the strapping means comprises a strap having two ends, one end having hook material and the other end having loop material, such that the strap may be fastened tightly around the can by placing the hook material on the loop material. However, other suitable fastening means may be used.

The strapping means is attached to a swivelling means which allows the object to pivot so that when a user bends over at an angle, the swivelling means will adjust so that the object remains substantially level at all times so as to prevent spillage therefrom. In the preferred embodiment the swivelling means is a ball bearing device attached to the main body of the holder and the strapping means.

DESCRIPTION OF PREFERRED EMBODIMENTS

Figure 1:
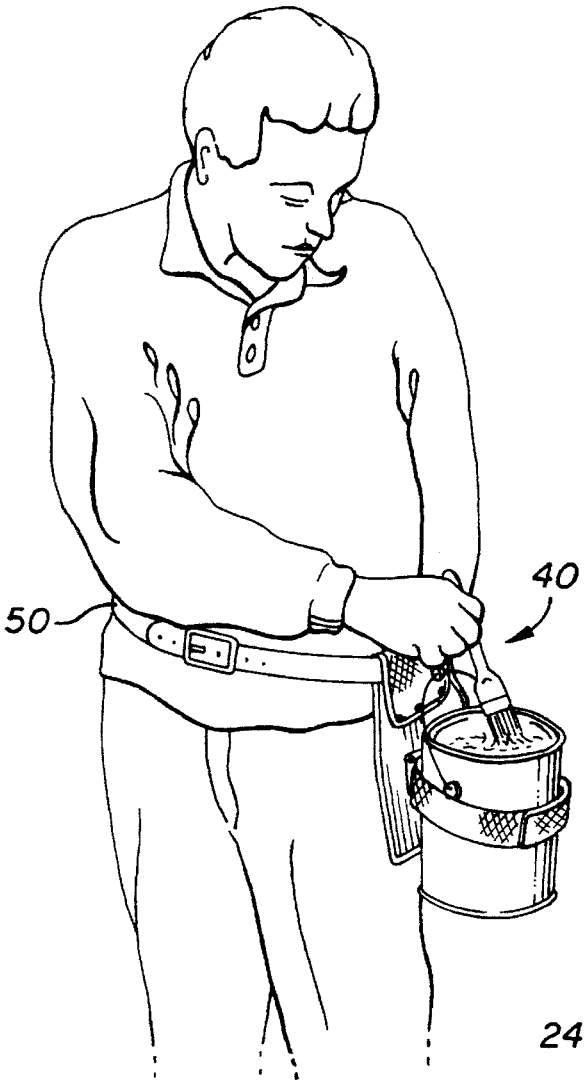
FIG. 1 is a perspective view of the paint can holder, holding a paint can, on a user of the device.
Figure 2:
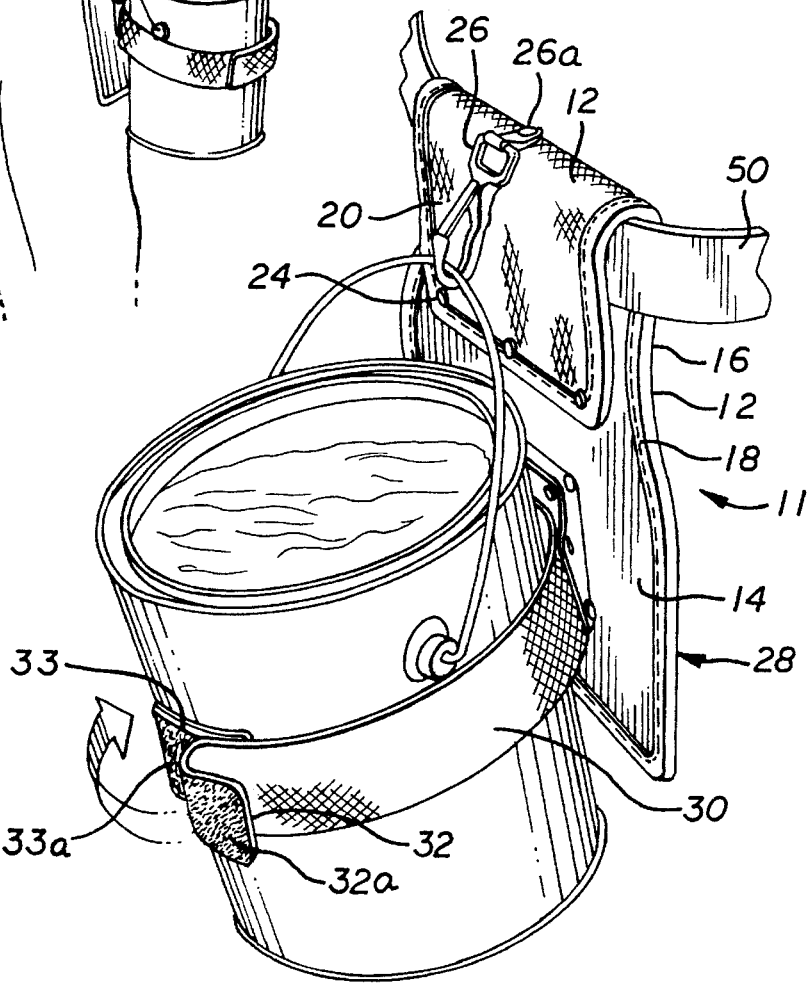
FIG. 2 is a close up perspective view of the paint can holder holding a paint can.
Figure 3:
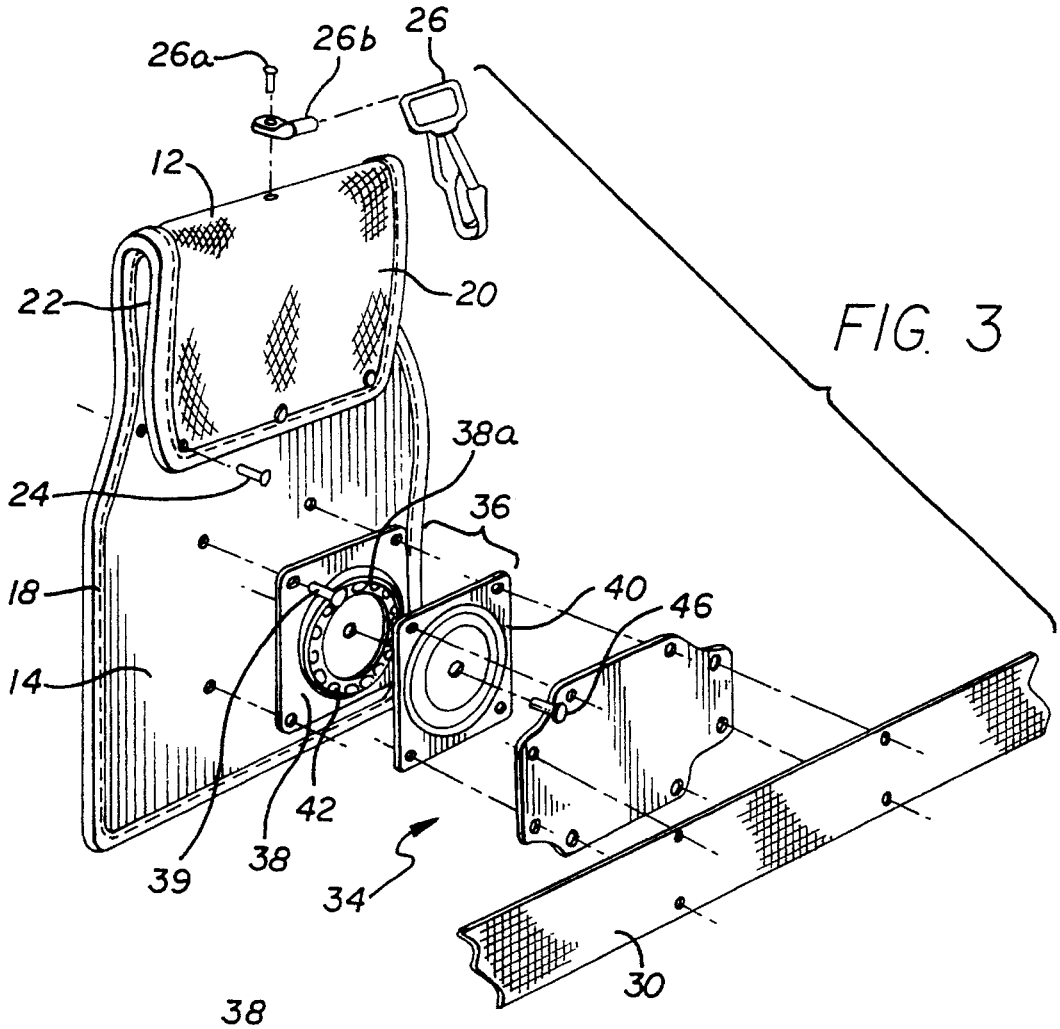
FIG. 3 is a partially fragmented rear elevational view of the paint can holder in opened condition.
Figure 6:
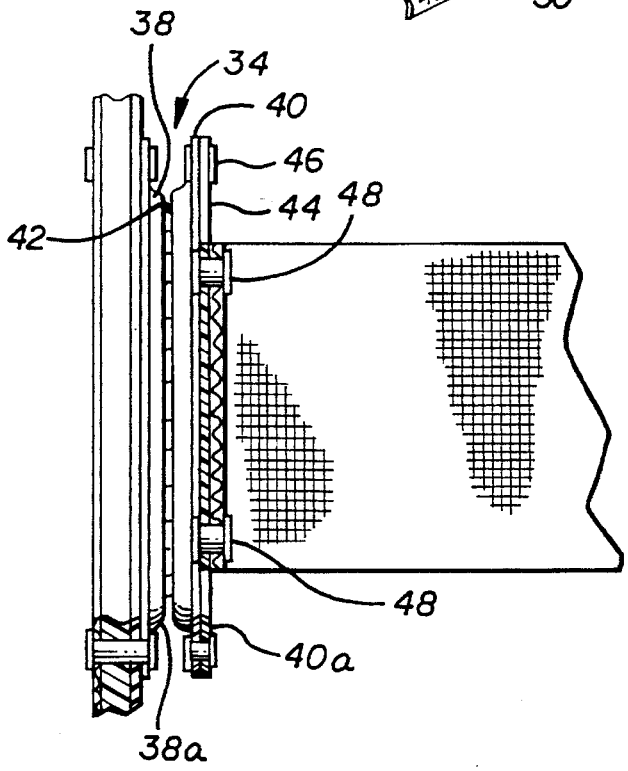
FIG. 6 is a side view of the paint can holder taken along lines 6—6 of FIG. 4.
Figure 4:
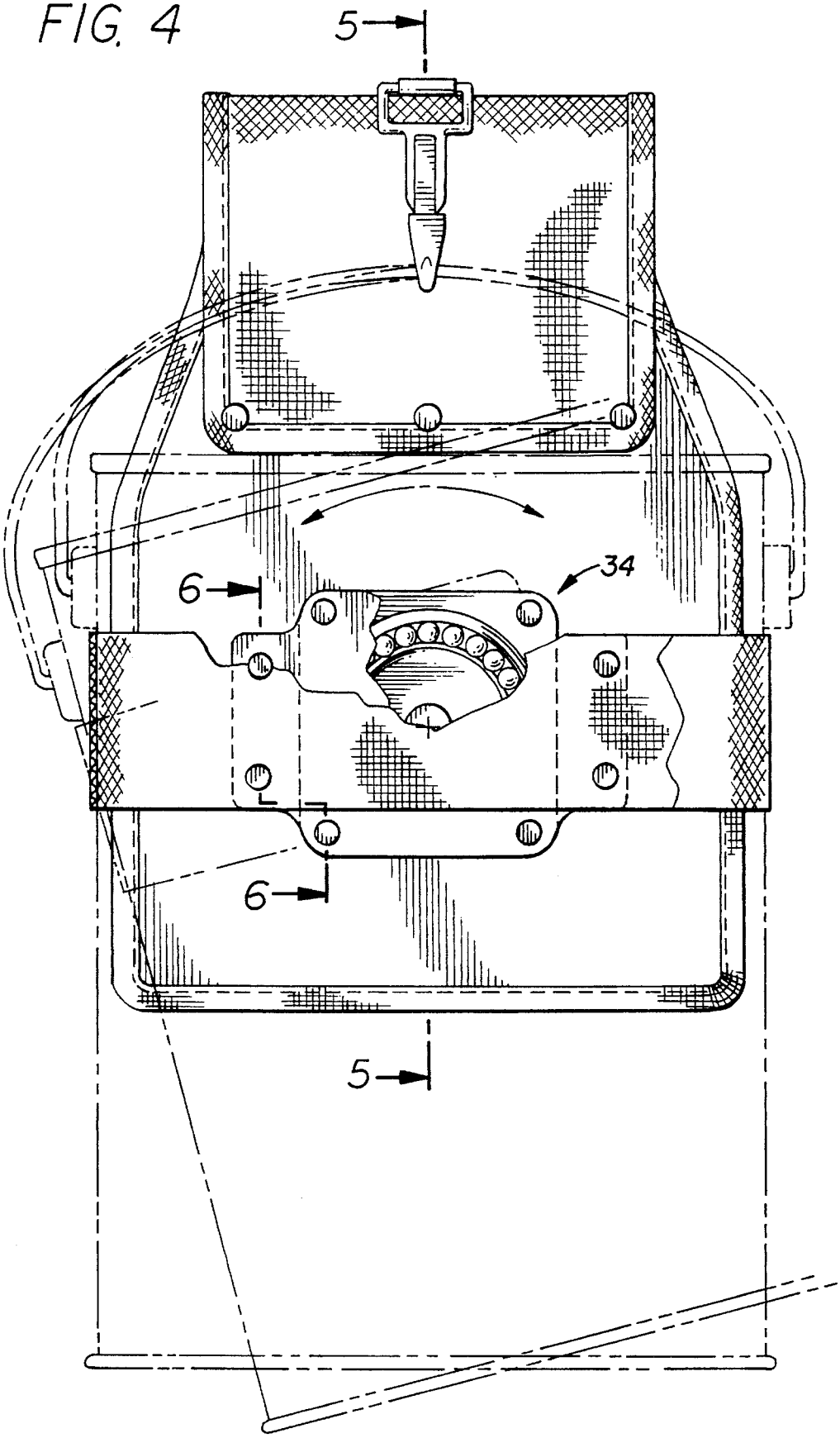
FIG. 4 is a partially fragmented rear elevational view of the paint can holder in opened condition, showing the paint can in phantom as it is swivelled.
Figure 5:
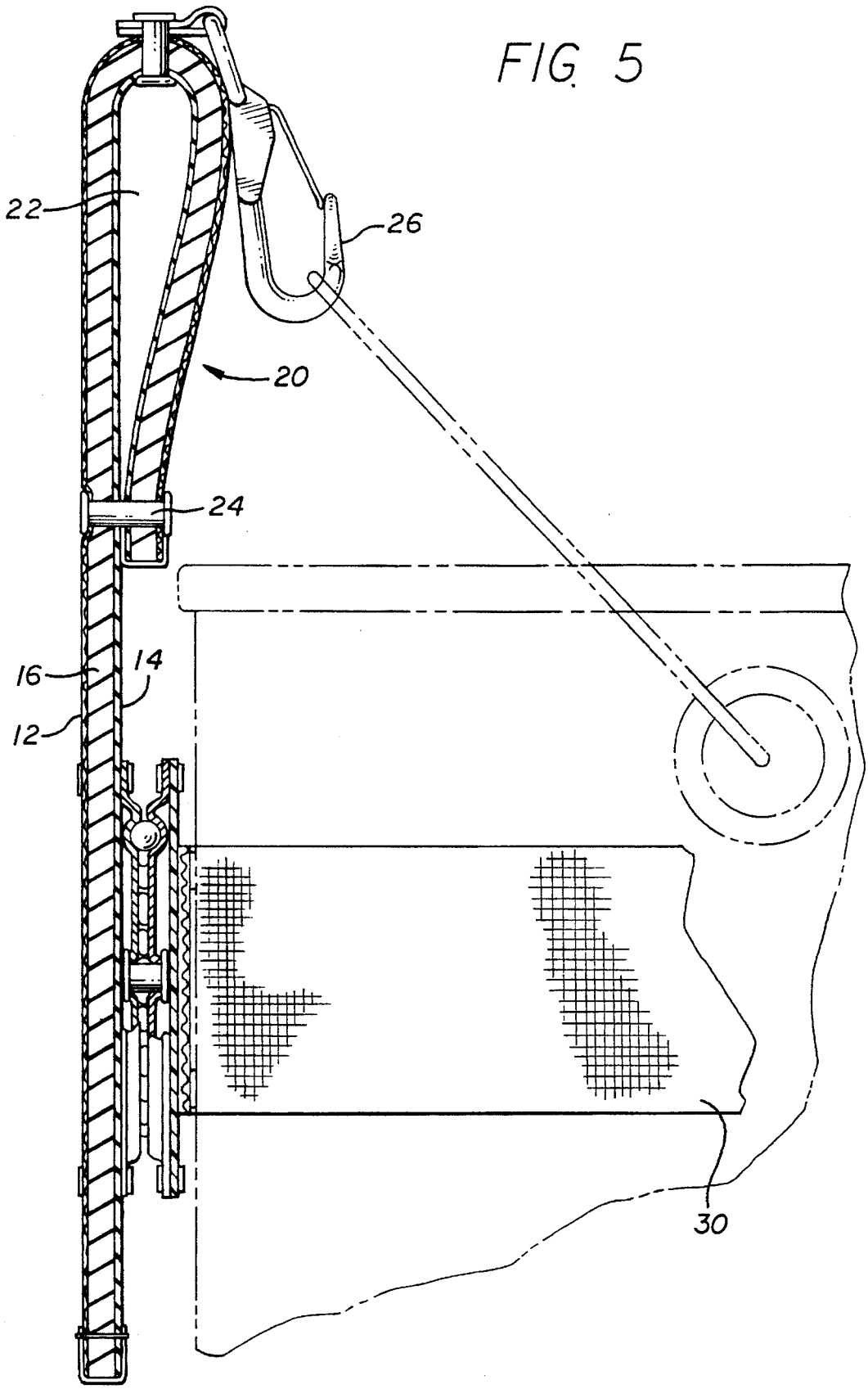
FIG. 5 is a side view of the paint can holder taken along lines 5—5 of FIG. 4, showing the paint can in phantom.

Referring to the drawings, there is shown in FIGS. 1 through 6 a paint can holder 10 comprises a main body 11 having three layers 12, 14 and 16 of material. The first layer 12, which is the layer closest to the body of the user, is comprised of a material such as a heavy duty fabric. The second outer layer 14, which is the layer closest to the object being held, is made of hard plastic or any other substantially rigid material. The third layer 16, lies between the first and second outer layers 12 and 14. In the preferred embodiment, layer 16 is comprised of foam for padding and comfort of the user. The three layers 12 14 and 16 are held together by a binding 18, such as nylon, that is stitched around the outer edge of the three layers, as shown in FIGS. 2 and 3.

The uppermost portion 20 of the main body 11 is bent so as to form a belt loop 22, such that the first layer 12 appears over the top of the second layer 14. The loop 22 is formed by bending the uppermost portion 20 and affixing it to an adjacent portion of the remainder of the main body by fastening means, such as rivets 24.

A heavy duty snap or bracing device 26 is affixed to the top 20 of the main body 11 at or near the apex of the loop 22, for vertical support of a paint bucket (for example, by the handle). The bracing device 26 is affixed to the top 20 of the main body 11 by suitable fastening means 26*a*, which in the preferred embodiment comprises a metal loop 26*b* and rivet 26*c*.

In the lower portion 28 of the main body 11 on the second outer layer 14 is a means 30 for strapping a paint can or other object to the holder. In the preferred embodiment, the strapping means 30 comprises a strap having two ends 32 and 33, each end having fastening means thereon 32*a* and 33*a*, respectively, that may be fixedly engaged with each other. In the preferred embodiment, end 33 has hook material on the outside thereof and end 32 has loop material on the inside thereof, such that the strap may be fastened around the can by placing the hook material on the loop material, as shown in FIG. 2. However, any other suitable fastening means may be used that will hold the can or other object tightly and which will prevent the can or other object from slipping. Strapping means 30 are sized so as to accommodate varying paint can sizes and weights.

The strapping means 30 is attached to a swivelling means 34 which allows the can or other object to pivot. In the preferred embodiment the swivelling means 34 comprises a ball bearing device 36 having a first plate 38 with an indentation 38*a*, which is attached to the main body 10 of the holder 11 by rivets 39 or other suitable fastening means, and a second plate 40 with an indentation 4O*a*, which is attached to a bracing means 44 by rivets 46 or other suitable fastening means. Plates 38 and 40 are held in place by ball bearings 42 which snap into both of the plates and allow the swivelling means 34 to swivel.

Bracing means 44 is attached to strapping means 30 by rivets 48 or other suitable fastening means.

Use of the paint can holder 11 is illustrated in FIGS. 1, 2, 4 and 5. A belt 50 is placed through the loop 22 so that the paint can holder 11 is facing with the strapping means 30 on the outside of the belt. The belt is then placed around the waist or the hip of the user.

A paint can or other object to be used is placed on holder 11 by fastening the strapping means 30 around the can so that end 32 is overlapped and fastened onto end 33 by fastening strips 33*a* and 32*a* to each other to releasably hold the paint can in tension. The can or other object is further held in place by affixing the handle thereof to bracing means 26, so that the can or other object will always be held in a vertical position.

When the user bends over at an angle, the swivelling means 34 will adjust the can or other object so that it remains substantially upright and level to prevent spillage therefrom.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

What is claimed is:

1. A support device for an object having a handle, the device being worn on a belt of a user, comprising:

a flat base comprised of a first layer of substantially rigid material, a second layer of heavy duty fabric material, and a third layer of cushioning material, which is placed between the first and second layer, said base having a top and a bottom portion, the top portion being folded over the bottom portion and affixed thereto to form a loop having an apex, said loop for receiving the belt of the user, wherein the bottom portion is substantially longer than the top portion and the top portion has an outer surface of said second layer, pivoting clipping means attached to the base so that it hangs on the outer surface of the second layer of the top portion at or near the apex of the loop for holding the handle of the object so that the object will always be held in a vertical position, ball bearing swivelling means attached to the first layer of said bottom portion of said base, strapping means attached to said ball bearing swivelling means for enclosing said object therein, whereby when the object is placed in the strapping means and the handle thereof is attached to the pivoting clipping means, when the user bends over at an angle, the swivelling means will adjust the object so that it remains substantially upright and level to prevent spillage therefrom.

2. The device of claim 1 wherein said pivoting clipping means is a closable hook.

* * * * *